US005826320A

United States Patent [19]

Rathke et al.

[11] Patent Number: 5,826,320

[45] Date of Patent: Oct. 27, 1998

[54] ELECTROMAGNETICALLY FORMING A TUBULAR WORKPIECE

[75] Inventors: John Rathke, Centerport; Elvin Charles Burger, New York; Edward M. Peterson, Syosset; Christopher J. Horan, Huntington, all of N.Y.

[73] Assignee: Northrop Grumman Corporation, Los Angeles, Calif.

[21] Appl. No.: 780,498

[22] Filed: Jan. 8, 1997

[51] Int. Cl.[6] ..... B23P 17/00

[52] U.S. Cl. ..... 29/419.2; 72/56

[58] Field of Search ..... 29/419.2, 421.1; 72/56; 264/427; 425/3

[56] References Cited

U.S. PATENT DOCUMENTS

| | | | |
|---|---|---|---|
| 2,976,907 | 3/1961 | Harvey et al. | 29/419.2 |
| 3,088,200 | 5/1963 | Birdsall et al. . | |
| 3,092,165 | 6/1963 | Harvey | 29/419.2 |
| 3,394,569 | 7/1968 | Smith | 72/56 |
| 4,261,092 | 4/1981 | Corwin | 29/421.1 |
| 4,334,417 | 6/1982 | Victor | 72/56 |
| 4,513,598 | 4/1985 | Costabile | 29/421.1 |
| 4,531,393 | 7/1985 | Weir | 72/56 |
| 4,590,655 | 5/1986 | Javorik | 29/421.1 |
| 4,840,053 | 6/1989 | Nakamura | 29/421.1 |
| 4,878,434 | 11/1989 | Sommet | 102/514 |
| 4,947,667 | 8/1990 | Gunkel et al. | 72/56 |
| 4,962,656 | 10/1990 | Kunerth et al. | 72/56 |
| 5,097,689 | 3/1992 | Pietrobon | 29/421.1 |
| 5,331,832 | 7/1994 | Cherian et al. | 72/56 |
| 5,454,154 | 10/1995 | Cherian et al. | 29/426.4 |
| 5,485,737 | 1/1996 | Dickerson | 29/421.1 |

*Primary Examiner*—David P. Bryant
*Attorney, Agent, or Firm*—Terry J. Anderson; Karl J. Hoch, Jr.

[57] ABSTRACT

A process is provided for electromagnetically forming an elongated tubular workpiece by applying an electromagnetic force provided by an energized workcoil to the workpiece radially of its longitudinal axis and by simultaneously applying an axial compressive force to the workpiece. The axial compressive force may be applied to the workpiece from a time before applying the radial electromagnetic force. A forming member including a surface having a desired contour is provided adjacent the workpiece and the workpiece is caused by the electromagnetic force to conformingly engage the surface of the forming member and thereby assume the contoured shape of the forming member. The forming member may be a forming die which surrounds the workpiece or a forming mandrel may be positioned within the workpiece. In another embodiment, both a forming die and a forming mandrel may be employed for performing the forming operation at longitudinally spaced regions of the workpiece. The axial compressive force may be applied to the workpiece at one or both ends by positioning in engagement with an end of the workpiece one surface of a plate member of electrically conductive material, the plate member lying in a plane transverse of the longitudinal axis of the workpiece, and positioning adjacent to but electrically isolated from a second surface of the plate member a flat electrically conductive coil, then energizing the coil to create a force directed against the plate member to thereby compress the workpiece between its ends.

6 Claims, 2 Drawing Sheets

ELECTROMAGNETICALLY FORMING A TUBULAR WORKPIECE

BACKGROUND OF THE INVENTION

1. Field of the Invention

This invention relates generally to electromagnetic forming of metals and, more particularly, to forming metallic workpieces into complex shapes rapidly, easily, and with consistency.

2. Description of the Prior Art

Electromagnetic forming is a process for shaping a metal product (called the workpiece) by means of the application of electromagnetic forces. Electromagnetic forming relies on the interaction of the electromagnetic field with the metal of the workpiece. The electromagnetic field is produced by passing a time varying electric current through a coil referred to as the workcoil). The current in the workcoil can be provided by the discharge of a capacitor (or more typically by a bank of capacitors) resulting in a pulse output. The workpiece can be maintained at a temperature so that it is somewhat malleable to aid the forming process, although this is not necessary.

The electromagnetic forming process has several clear advantages. For example, there is no frictional contact between the workpiece and the field thereby allowing for a high quality finish on the workpiece. Also, the pulsed application of the electromagnetic field to the workpiece can be readily adapted to an automated "assembly line"-type process. Another advantage is that electromagnetic forming can be adapted to the formation of irregular shapes.

Electromagnetic forming processes typically display several different configurations. In one configuration, the workpiece surrounds the workcoil so the action of the field tends to expand or bulge the workpiece. In another configuration, the workcoil and workpiece are adjacent to each other so that the field bends the workpiece away from the workcoil. Another configuration has the workcoil surrounding the workpiece so that the field compresses the workpiece. In an example of this latter configuration, electromagnetic forming can be used to compress bands of metal on cylindrical-shaped molds.

An early disclosure which is exemplary of the electromagnetic forming technique is U.S. Pat. No. 3,088,200 to Birdsall et al. A number of other patents disclose a variety of improvements in the technique. These include U.S. Pat. Nos. 5,331,832 to Cherian et al., No. 4,962,656 to Kunerth et al., No. 4,947,667 to Gunkel et al., No. 4,878,434 to Sommet, No. 4,531,393 to Weir, and No. 4,334,417 to Victor. However, in their disclosures, none of these patents combine axial loading of the member to be formed, or workpiece, with the electromagnetic forming process as is taught by the instant disclosure. While U.S. Pat. No. 4,261,092 to Corwin combines an axial compressive load with an electromagnetic forming pulse, in this instance, the axial compressive load is applied to the non-forming part of the assembly, namely, the ceramic mandrel, to prevent its destruction by the impact of the electromagnetically formed tubular member that is swaged to it. Finally, U.S. Pat. No. 4,590,655 to Javorik discloses a method and apparatus for cold forming of metal and, more specifically, for mechanically expanding an elongated tubular member in directions transverse to the longitudinal axis of the member. However, there is no suggestion in the Javorik patent of using the electromagnetically forming technique.

It was in light of the foregoing that the present invention was conceived and has now been reduced to practice.

SUMMARY OF THE INVENTION

The present invention relates to a process for electromagnetically forming an elongated tubular workpiece by applying an electromagnetic force provided by an energized workcoil to the workpiece radially of its longitudinal axis and by simultaneously applying an axial compressive force to the workpiece. The axial compressive force may be applied to the workpiece from a time before applying the radial electromagnetic force. A forming member including a surface having a desired contour is provided adjacent the workpiece and the workpiece is caused by the electromagnetic force to conformingly engage the surface of the forming member and thereby assume the contoured shape of the forming member. The forming member may be a forming die which surrounds the workpiece or a forming mandrel may be positioned within the workpiece. In another embodiment, both a forming die and a forming mandrel may be employed for performing the forming operation at longitudinally spaced regions of the workpiece. The axial compressive force may be applied to the workpiece at one or both ends by positioning in engagement with an end of the workpiece one surface of a plate member of electrically conductive material, the plate member lying in a plane transverse of the longitudinal axis of the workpiece, and positioning adjacent to but electrically isolated from a second surface of the plate member a flat electrically conductive coil, then energizing the coil to create a force directed against the plate member to thereby compress the workpiece between its ends.

A particularly desirable application for the invention resides in the fabrication of niobium superconducting cavities. Niobium and many of its alloys exhibit superconductivity, that is, the lack of electrical resistance at very low temperatures. As a result, niobium is of great interest in applications relating to power generation, propulsion devices, fusion research, electronic devices, and in numerous other applications. In a typical application, electron beam accelerators, it is desirable to fabricate a series of Niobium superconducting cavities which are joined in an end-to-end relationship. Current methods of fabricating niobium superconducting cavities require expensive and undesirable processes. Drawn cavity sections are often formed using tooling that contacts the niobium metal with high contact pressure. This contact contaminates the niobium metal. Since the drawing process forms only half cavities, the sections are subsequently joined by electron beam welding. Electron beam welding is expensive and, as with any weld, there may be voids and leaks.

Electromagnetic forming of cavities eliminates high contact pressures since the material is moved by an electromagnetic field. This process also allows the forming of whole cavities or strings of cavities, thus eliminating the need for electron beam welding at the major and minor diameter joints.

This invention applies the electromagnetic forming process to the unique geometry and material of superconducting cavities. The cavities would be formed by starting with niobium tubing, inserting an expansion coil and associated field shaper, surrounding the tubing with female tooling of the appropriate shape, and applying a current pulse or pulses to form the tubing into the tool cavity. Where extreme amounts of deflection are required, a tube with a diameter between the major and minor diameters of the desired cavity may be formed in two steps. The major diameter would be formed as described above; the minor diameters at the outboard ends of the cavity may be formed by using male tooling inside the cavity and a compression coil and field shaper outside of he tube to compress the tube when the forming pulse is applied.

Thus, when used to form superconducting cavities, the invention:

- eliminates the need for electron beam welding at the cavity's major and minor diameters; and
- reduces or eliminates the contamination of the niobium metal caused by the high tool contact pressure required in the drawing process.

Accordingly, a primary feature of the present invention is the provision of an improved technique for the electromagnetic forming of metals.

Another feature of the present invention is the provision of such a technique which enables the forming of metallic workpieces into complex shapes rapidly, easily, and with consistency.

A further feature of the present invention is the provision of such a technique which includes electromagnetically forming an elongated tubular workpiece by applying an electromagnetic force provided by an energized workcoil to the workpiece radially of its longitudinal axis and by simultaneously applying an axial compressive force to the workpiece.

A further feature of the present invention is the provision of such a technique according to which the axial compressive force may be applied to the workpiece from a time before applying the radial electromagnetic force.

Still another feature of the invention is the provision of such a technique according to which a forming member including a surface having a desired contour is provided adjacent the workpiece and the workpiece is caused by the electromagnetic force to conformingly engage the surface of the forming member and thereby assume the contoured shape of the forming member.

Yet a further feature of the present invention is the provision of such a technique according to which the forming member may be a forming die which surrounds the workpiece or a forming mandrel which may be positioned within the workpiece.

Yet another feature of the invention is the provision of such a technique according to which both a forming die and a forming mandrel may be employed for performing the forming operation at longitudinally spaced regions of the workpiece, the axial compressive force being applied to the workpiece at one or both ends by positioning in engagement with an end of the workpiece one surface of a plate member of electrically conductive material, the plate member lying in a plane transverse of the longitudinal axis of the workpiece, and positioning adjacent to but electrically isolated from a second surface of the plate member a flat electrically conductive coil, then energizing the coil to create a force directed against the plate member to thereby compress the workpiece between its ends.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
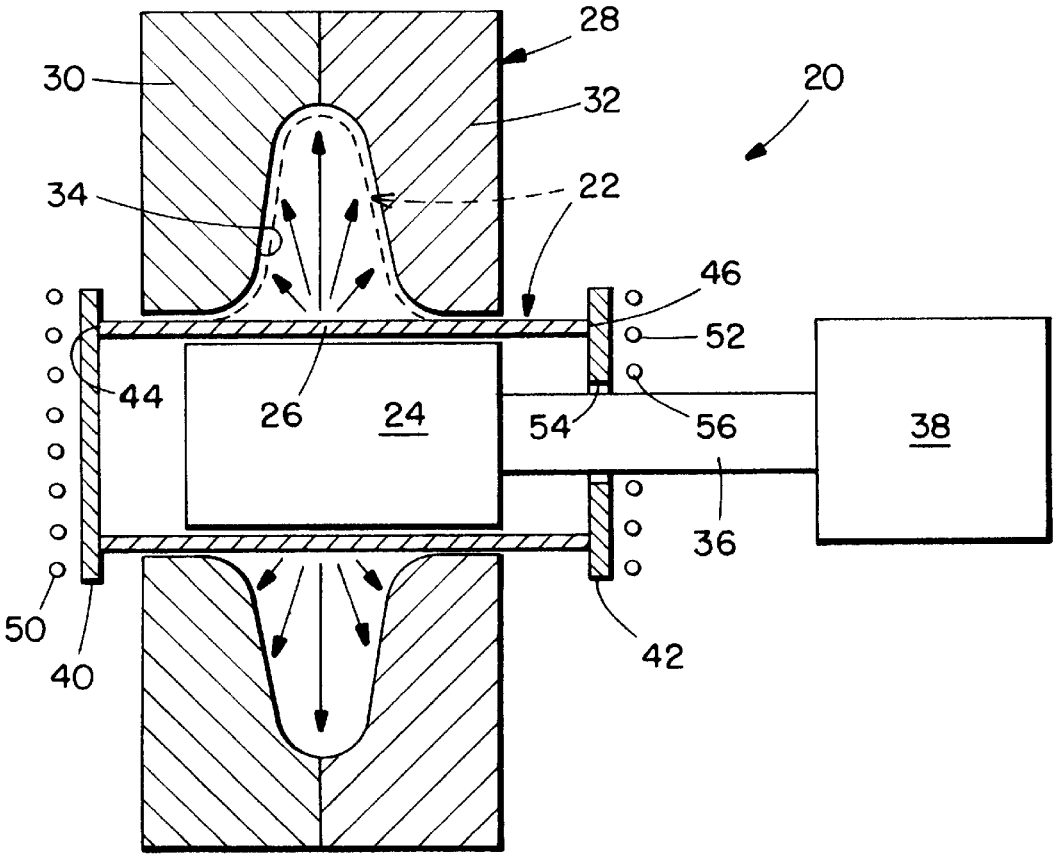
FIG. 1 is a diagrammatic side elevation view, partly in section, illustrating apparatus operatively embodying the invention for electromagnetically forming an elongated tubular workpiece.
Figure 2:
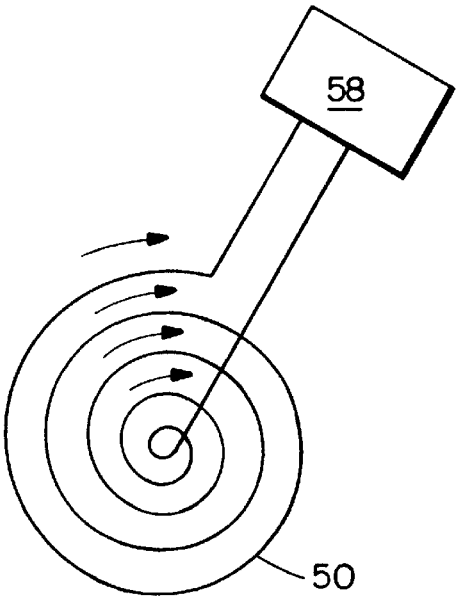
FIG. 2 is a diagrammatic front elevation view of one of the components illustrated in FIG. 1.

Turn now to the drawings and, initially, to FIG. 1 which generally illustrates, diagrammatically, apparatus 20 for electromagnetically forming an elongated tubular workpiece 22 such that at the end of the operation about to be described, it will have the shape indicated by dashed lines in the figure.

This is achieved, in a first instance, by surrounding a workcoil 24 with a central region of the workpiece 22 while positioning a forming female die 28, preferably having a pair of removable die parts 30, 32 including an inner surface 34 having a desired inner contour, so as to substantially surround the workpiece at a location generally coextensive with its central region 26. The workcoil 24 is physically and electrically connected by a suitable intermediary member 36 to an energizing source 38 which is preferably a bank of capacitors having the requisite charge capacity. Thereupon the workcoil 24 is energized by the source 38 so as to apply an electromagnetic force to the central region 26 of the workpiece 22 radially of the longitudinal axis of the workpiece. By so doing, the first region 26 of the workpiece 22 conformingly engages the inner surface 34 of the forming die 28 and thereby assumes the contoured shape of the forming die.

Either simultaneously with the operation of the workcoil 24 or from a time prior to the operation of the workcoil 24, an axial compressive force is applied to the workpiece. To this end, a pair of opposed plate members 40, 42 of electrically conductive material are positioned in engagement with each opposed end 44, 46, respectively, of the workpiece 22. Each of the plate members 40, 42 lies in a plane transverse of the longitudinal axis of the workpiece. Thereupon, a flat electrically conductive coil 50 is positioned adjacent to but electrically isolated from a surface of the plate member 40 opposite the end 44 of the workpiece 22. In a similar manner, a flat electrically conductive coil 52 is positioned adjacent to but electrically isolated from a surface of the plate member 42 opposite the end 46 of the workpiece 22. It will be appreciated that both the plate member 42 and the flat coil 52 are formed with central openings 54, 56, respectively, to accommodate the passage therethrough of the intermediary member 36 extending between the workcoil 24 and the energizing source 38.

Figure 3:
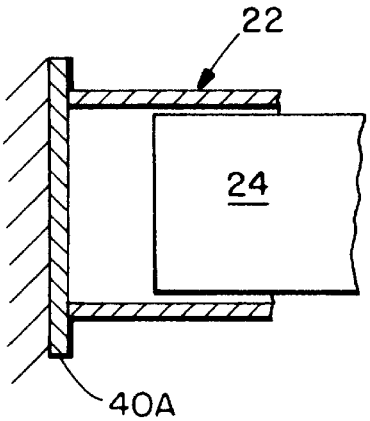
FIG. 3 is a detail side elevation view partially in section illustrating another embodiment of the apparatus depicted in FIG. 1.

The flat electrically conductive coils 50, 52 are then energized, as by a suitable EMF source 56 to create a force generally aligned with the longitudinal axis of the workpiece 22 and directed against each plate member 40, 42 to thereby compress the workpiece between the ends 44 and 46. In another embodiment, as illustrated in FIG. 3, a modified plate member 40A is held stationary and the flat coil 52 is energized to thereby drive the plate member 42 against the end 46 of the workpiece 22. The result achieve is similar to that of the FIG. 1 embodiment, but without the aid of the coil 50.

Figure 4:
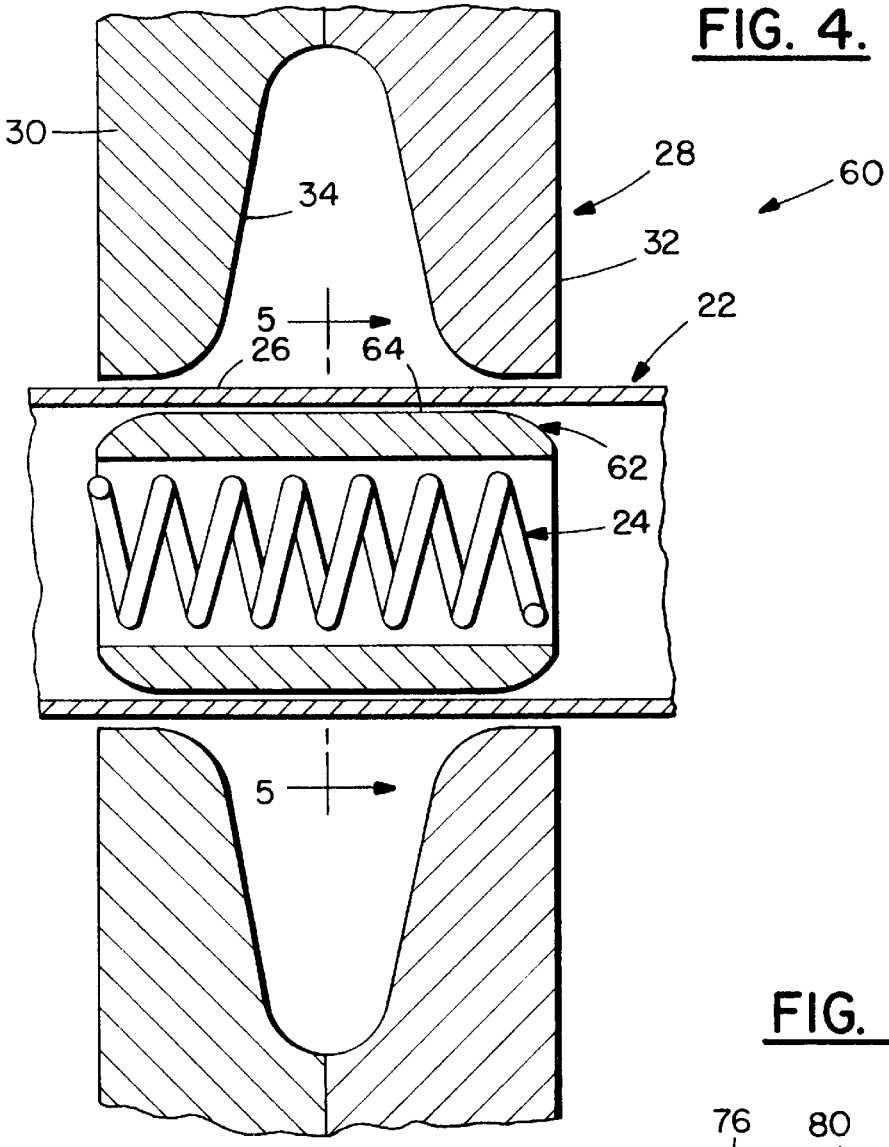
FIG. 4 is a diagrammatic side elevation view, in section, generally similar to FIG. 1 and illustrating another embodiment of the invention.
Figure 5:
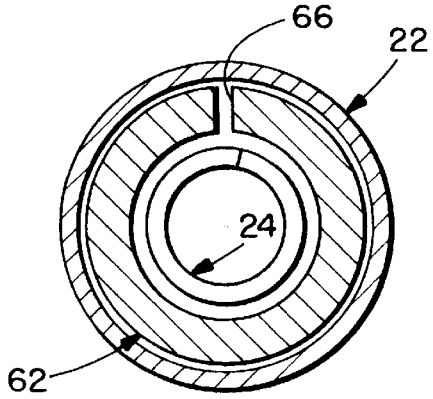
FIG. 5 is a cross section view taken generally along line 5—5 in FIG. 4.

Turn now to FIGS. 4 and 5 for the description of another embodiment of the invention. In this instance, apparatus 60 for electromagnetically forming the elongated tubular workpiece 22 includes a tubular field shaper 62 of electrically conductive material positioned intermediate the forming die 28 and the workcoil 24. The field shaper 62 has an outer contoured surface 64 for optimum shaping of the workpiece 22 in conformity with the surface 34 of the forming die 28. Preferably of beryllium copper alloy and split longitudinally as indicated at 66 (FIG. 5), the field shaper 62 operates to optimize the operation of inducing the central region of the workpiece to most readily conform to the contour of the inner surface 34 for a given thickness of the workpiece. For example, the field can be reduced near the entry to the die cavity to reduce the pressure exerted, and therefore the friction between the workpiece and the die.

Figure 6:
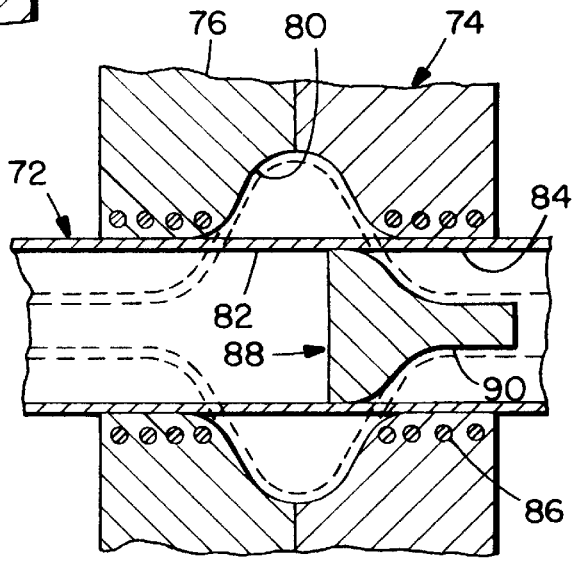
FIG. 6 is a diagrammatic side elevation view, in section, generally similar to FIGS. 1 and 4 and illustrating another embodiment of the invention.

In still another embodiment of the invention, referring now to FIG. 6, provision is made for the instance in which the thickness of a workpiece 72 is relatively great or in which the material of the workpiece is relatively hard. In such an instance, it may be difficult to deform the workpiece 72 to conform to an inner surface 34 (FIGS. 1 and 4) which is relatively deep. In such an instance, it might be desirable to provide a forming die 74 including die parts 76, 78 having an inner surface 80 having a desired contour which substantially surrounds the workpiece. A central region 82 of the workpiece 72 may then be operated upon as previously described to conform, as indicated by dashed lines in FIG. 6, with the inner surface 80. However, as noted above, the depth of the inner surface 80 is not as great as that of the inner surface 34.

In order to complete the forming operation, a second region 84 of the workpiece which is longitudinally spaced from the central region 82 is surrounded with a second workcoil 86 which may be a part of the forming die 74 or part of a separate or distinct component. In this instance, a forming mandrel 88 including an outer surface having a desired outer contour is positioned within the workpiece 72 at a location generally coextensive with the second region 84 of the workpiece. The workcoil 86 is then energized so that the second region 84 of the workpiece 72 conformingly engages the contoured outer surface 90 of the forming mandrel 88 and thereby assumes the contoured shape of the forming mandrel. This completes the forming operation and the resulting formed workpiece is indicated by dashed lines in FIG. 6.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A process for electromagnetic forming of an elongated tubular metallic workpiece having a longitudinal axis into a product having a complex outer shape comprising the steps of:

(a) providing a workcoil connected to an energizing source;

(b) surrounding the workpiece with the workcoil of step (a);

(c) positioning a forming mandrel including an outer surface having a desired outer contour within the workpiece;

(d) energizing the workcoil so that an electromagnetic force is applied radially of the longitudinal axis of the work-piece such that the workpiece conformingly engages the outer contoured surface of the forming mandrel and thereby assumes the contoured shape of the forming mandrel; and (e) simultaneously with step (d), applying an axial compressive force to the workpiece.

2. A process as set forth in claim 1 including the step of:

applying an axial compressive force to the workpiece prior to performing step (d).

3. A process as set forth in claim 1 wherein step (e) includes the steps of:

holding stationary a first end of the workpiece;

positioning in engagement with a second end of the workpiece one surface of a plate member of electrically conductive material, the plate member lying in a plane transverse of the longitudinal axis of the workpiece;

positioning adjacent to but electrically isolated from a second surface of the plate member a flat electrically conductive coil; and energizing the flat electrically conductive coil to create a force generally aligned with the longitudinal axis of the workpiece and directed against the plate member to thereby compress the workpiece between the first and second ends thereof.

4. A process as set forth in claim 1 wherein step (e) includes the steps of:

positioning in engagement with each opposed end of the workpiece one surface of a plate member of electrically conductive material, the plate member lying in a plane transverse of the longitudinal axis of the workpiece;

positioning adjacent to but electrically isolated from a second surface of each plate member a flat electrically conductive coil; and energizing the flat electrically conductive coils to create a force generally aligned with the longitudinal axis of the workpiece and directed against each plate member to thereby compress the workpiece between the first and second ends thereof.

5. A process for electromagnetic forming of an elongated tubular metallic workpiece having adjoining first and second regions and a longitudinal axis into a product having a complex outer shape comprising the steps of:

(a) surrounding a first workcoil connected to an energizing source with the first region of the workpiece;

(b) positioning a forming die including an inner surface having a desired inner contour so as to substantially surround the workpiece at a location generally coextensive with the first region of the workpiece;

(c) energizing the first workcoil so that an electromagnetic force is applied radially of the longitudinal axis of the workpiece such that the first region of the workpiece conformingly engages the inner surface of the forming die and thereby assumes the contoured shape of the forming die;

(d) surrounding the second region of the workpiece longitudinally spaced from the first region thereof with a second workcoil connected to an energizing source;

(e) positioning a forming mandrel including an outer surface having a desired outer contour within the workpiece at a location generally coextensive with the second region of the workpiece; and (f) energizing the workcoil second so that an electromagnetic force is applied radially of the longitudinal axis of the workpiece such that the second region of the workpiece conformingly engages the contoured outer surface of the forming mandrel and thereby assumes the contoured shape of the forming mandrel.

6. A process for electromagnetic forming of an elongated tubular metallic workpiece having adjoining first and second regions and a longitudinal axis into a product having a complex outer shape comprising the steps of:

(a) providing a tubular field shaper of electrically conductive material and having an outer contour for optimum shaping of the first region of the workpiece and a workcoil within the field shaper connected to an energizing source;

(b) surrounding the field shaper of step (a) with the first region of the workpiece;

(c) positioning a forming die including an inner surface having a desired inner contour so as to substantially surround the first region of the workpiece;

(d) energizing the workcoil within the field shaper so that an electromagnetic force is applied radially of the longitudinal axis of the workpiece against the workpiece such that the field shaper induces the first region of the workpiece to conform to the inner surface of the forming die and thereby assume the contoured shape of the forming die;

(e) surrounding the second region of the workpiece longitudinally spaced from the first region thereof with a second workcoil connected to an energizing source;

(f) positioning a forming mandrel including an outer surface having a desired outer contour within the workpiece at a location generally coextensive with the second region of the workpiece; and (g) energizing the second workcoil so that an electromagnetic force is applied radially of the longitudinal axis of the workpiece such that the second region of the workpiece conformingly engages the contoured outer surface of the forming mandrel and thereby assumes the contoured shape of the forming mandrel.

* * * * *